US010221631B2

(12) United States Patent
Reddy et al.

(10) Patent No.: US 10,221,631 B2
(45) **Date of Patent: *Mar. 5, 2019**

(54) SIDE SADDLE SUBSTRUCTURE

(71) Applicant: NABORS DRILLING USA, LP, Houston, TX (US)

(72) Inventors: Padira Reddy, Houston, TX (US); Ashish Gupta, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 8 days.

This patent is subject to a terminal disclaimer.

(21) Appl. No.: 15/853,283

(22) Filed: Dec. 22, 2017

(65) Prior Publication Data

US 2018/0119496 A1 May 3, 2018

Related U.S. Application Data

(63) Continuation of application No. 15/191,094, filed on Jun. 23, 2016, which is a continuation of application
(Continued)

(51) Int. Cl.
*E21B 7/02* (2006.01)
*E21B 15/00* (2006.01)
(Continued)

(52) U.S. Cl.
CPC ..... *E21B 15/003* (2013.01); *E21B 7/02* (2013.01); *E21B 21/065* (2013.01); *E21B 21/106* (2013.01); *E21B 33/06* (2013.01)

(58) Field of Classification Search
CPC . E21B 7/02; E21B 15/00; E21B 7/022; E04D 12/18; E04H 12/18
See application file for complete search history.

(56) References Cited

U.S. PATENT DOCUMENTS 1,733,484 A 10/1929 Davis
2,332,479 A 10/1943 Woolslayer et al.
(Continued)

FOREIGN PATENT DOCUMENTS

CA 2755483 A1 11/2010
CA 2753417 A1 2/2011
(Continued)

OTHER PUBLICATIONS

Nabors 990 Proyecto Llanos.WMV; https://www.youtube.com/watch?v=6BgfgWumRIU, Nabors Rig 990 Chichimene, Colombia; Youtube.com; Aug. 10, 2011 (231 pages).
(Continued)

*Primary Examiner* — Kenneth L Thompson
(74) *Attorney, Agent, or Firm* — Adolph Locklar

(57) ABSTRACT

The drilling rig includes a first substructure and a second substructure. The second substructure is positioned generally parallel to and spaced apart from the first substructure and generally the same height as the first substructure. The drilling rig further includes a drill rig floor coupled to the first and second substructures, where the drill rig floor positioned substantially at the top of the first and second substructures.

8 Claims, 4 Drawing Sheets

Related U.S. Application Data

No. 14/180,049, filed on Feb. 13, 2014, now Pat. No. 9,810,027.

(60) Provisional application No. 61/764,259, filed on Feb. 13, 2013.

(51) Int. Cl.

| | |
|---|---|
| ***E21B 21/06*** | (2006.01) |
| ***E21B 21/10*** | (2006.01) |
| ***E21B 33/06*** | (2006.01) |

(56) References Cited

U.S. PATENT DOCUMENTS 2,345,253 A 3/1944 Funk
2,347,115 A 4/1944 Lewis
2,594,847 A * 4/1952 Bates ..... E21B 15/00 173/151
3,028,881 A 4/1962 Koomey et al.
3,433,268 A 3/1969 Greer
3,483,933 A * 12/1969 Dyer ..... E21B 15/00 173/39
3,676,984 A * 7/1972 Clark ..... B01D 19/0021 96/198
3,716,149 A * 2/1973 Scaggs ..... E21B 19/155 414/22.52
3,739,853 A 6/1973 Wales
3,802,137 A 4/1974 Armstrong
3,851,770 A 12/1974 Jenkins et al.
3,922,825 A 12/1975 Eddy et al.
3,942,593 A * 3/1976 Reeve, Jr. ..... E21B 7/023 173/151
4,021,978 A 5/1977 Busse et al.
4,117,941 A 10/1978 McCleskey et al.
4,221,088 A 9/1980 Patterson
4,235,566 A 11/1980 Beeman et al.
4,267,675 A 5/1981 Cochran
4,290,495 A 9/1981 Elliston
4,403,898 A 9/1983 Thompson
4,421,179 A 12/1983 Boyadjieff
4,474,254 A 10/1984 Etter et al.
4,478,015 A 10/1984 Lawrence et al.
4,478,291 A 10/1984 Futros
4,488,708 A * 12/1984 Frye ..... B66D 1/16 254/355
4,493,382 A * 1/1985 Collins ..... E21B 21/01 175/206
4,587,778 A 5/1986 Woolslayer et al.
4,757,592 A 7/1988 Reed
4,759,414 A 7/1988 Willis
4,823,870 A 4/1989 Sorokan
4,834,604 A 5/1989 Brittain et al.
4,850,439 A 7/1989 Lund
4,899,832 A 2/1990 Bierscheid, Jr.
4,979,578 A 12/1990 Landry
5,107,940 A * 4/1992 Berry ..... E21B 7/023 175/122
5,248,005 A * 9/1993 Mochizuki ..... E21B 7/023 166/901
5,305,833 A 4/1994 Collins
5,375,667 A 12/1994 Trevisani
5,492,436 A 2/1996 Suksumake
6,161,358 A * 12/2000 Mochizuki ..... E21B 15/00 405/201
6,491,477 B2 12/2002 Bennett, Jr. et al.
6,634,436 B1 10/2003 Desai
6,779,614 B2 8/2004 Oser
6,848,515 B2 2/2005 Orr et al.
6,962,030 B2 11/2005 Conn
7,255,180 B2 8/2007 Beato et al.
7,306,055 B2 12/2007 Barnes
7,308,953 B2 12/2007 Barnes
7,308,963 B2 12/2007 Barnes
7,401,656 B2 7/2008 Wood et al.
7,404,697 B2 7/2008 Thompson
7,600,585 B2 10/2009 Patton et al.
7,628,229 B2 12/2009 Wood et al.
7,765,749 B2 8/2010 Palidis
7,819,207 B2 10/2010 Cowan
7,832,974 B2 11/2010 Fikowski et al.
7,878,254 B2 2/2011 Abdollahi et al.
7,931,076 B2 4/2011 Ditta et al.
7,967,540 B2 * 6/2011 Wright ..... E21B 19/155 166/377
7,992,646 B2 8/2011 Wright et al.
8,051,930 B1 11/2011 Barnes et al.
8,250,816 B2 8/2012 Donnally et al.
8,297,362 B1 10/2012 Strider et al.
8,316,588 B2 11/2012 Cicognani
8,468,753 B2 6/2013 Donnally et al.
8,474,216 B1 7/2013 Goerner
8,516,751 B2 8/2013 Konduc et al.
8,549,815 B2 10/2013 Donnally et al.
8,555,564 B2 * 10/2013 Wasterval ..... E21B 15/00 52/111
8,661,743 B2 3/2014 Flusche
8,720,128 B2 * 5/2014 Vogt ..... E21B 15/00 173/28
8,813,436 B2 8/2014 Donnally et al.
8,863,449 B2 10/2014 Donnally et al.
8,904,716 B2 12/2014 Donnally et al.
8,985,238 B2 3/2015 Sorokan et al.
8,985,928 B2 3/2015 Flusche
8,997,435 B2 4/2015 Reddy et al.
9,016,004 B2 4/2015 Vogt
9,027,287 B2 5/2015 Trevithick et al.
9,091,125 B2 7/2015 Konduc et al.
9,091,126 B2 7/2015 Thiessen et al.
9,132,871 B2 9/2015 Crisp et al.
9,140,080 B2 9/2015 Flusche
9,151,412 B2 10/2015 Trevithick et al.
9,163,462 B2 10/2015 Donnally et al.
9,212,481 B2 12/2015 Stramandinoli
9,228,394 B2 1/2016 Wijning et al.
9,249,626 B2 2/2016 Flusche
9,260,929 B2 2/2016 Mark
9,267,328 B2 2/2016 Flusche
9,309,728 B2 4/2016 Reddy et al.
9,291,012 B2 5/2016 Wells, Sr.
9,334,668 B2 5/2016 Wijning et al.
9,353,601 B2 5/2016 Hause
9,382,766 B2 7/2016 Flusche
9,399,890 B2 7/2016 Mark
9,441,423 B2 9/2016 Donnally et al.
9,366,053 B2 10/2016 Thiessen et al.
9,464,488 B2 10/2016 Thiessen
9,488,014 B2 11/2016 Sparkman et al.
9,562,407 B2 2/2017 Magnuson
9,631,443 B2 4/2017 Folk
9,650,840 B2 5/2017 Cheng et al.
9,677,298 B2 6/2017 Konduc et al.
9,708,861 B2 * 7/2017 Reddy ..... E21B 15/003
9,790,751 B2 10/2017 Reddy et al.
9,810,027 B2 * 11/2017 Reddy ..... E21B 15/003
9,845,813 B2 12/2017 Shimizu et al.
9,926,719 B2 * 3/2018 Reddy ..... E04H 12/345
2003/0172599 A1 * 9/2003 Frink ..... E21B 15/003 52/116
2004/0134666 A1 * 7/2004 Orr ..... E21B 19/002 166/379
2005/0126827 A1 6/2005 Berry
2006/0081379 A1 * 4/2006 Fehres ..... E21B 19/155 166/380
2008/0237170 A1 10/2008 Altman et al.
2009/0000218 A1 1/2009 Lee et al.
2009/0025980 A1 1/2009 Callander et al.
2009/0200856 A1 8/2009 Chehade et al.
2011/0072737 A1 3/2011 Wasterval
2012/0304553 A1 12/2012 Konduc et al.
2013/0305632 A1 11/2013 Rivera, Sr. et al.
2014/0224543 A1 8/2014 Padira et al.
2015/0143759 A1 5/2015 Sparkman et al.

(56) References Cited

U.S. PATENT DOCUMENTS

| | | | | |
|---|---|---|---|---|
| 2016/0010323 | A1* | 1/2016 | Konduc | E21B 7/02 52/69 |
| 2016/0298394 | A1* | 10/2016 | Padira | E21B 15/003 |
| 2016/0369570 | A1 | 12/2016 | Reddy et al. | |
| 2016/0376808 | A1* | 12/2016 | Magnuson | E21B 19/12 52/123.1 |
| 2017/0106925 | A1 | 4/2017 | Gupta et al. | |
| 2017/0292334 | A1* | 10/2017 | Reddy | E21B 15/003 |

FOREIGN PATENT DOCUMENTS

| | | | |
|---|---|---|---|
| CN | 201778661 | U | 3/2011 |
| DE | 849533 | C | 9/1952 |
| EP | 2751370 | B1 | 7/2014 |
| FR | 2556042 | A1 | 6/1985 |
| WO | 2016025521 | A2 | 2/2016 |
| WO | 2016048458 | A1 | 3/2016 |

OTHER PUBLICATIONS

Office Action issued in U.S. App. No. 15/191,140 dated Jul. 13, 2017 (12 pages).

Drilling Contractor; "Nabors modular Rig 702 in Papua New Guinea-bound for ExxonMobil"; Drilling Contractor, in Drilling Rigs & Automation, News, Jul. 6, 2011; 2 pages; www.drillingcontractor.org.

Drilling Contractor; "Nabors to base all future land rigs on Minimum Area AC rig concept"; Drilling Contractor, in News, Aug. 22, 2011; 2 pages; www.drillingcontractor.org.

Sebastion, Simone; "Big drill soon begins long commute to work"; Houston Chronicle, Sunday, Jul. 3, 2011; 3 pages; www.chron.com.

Gass, John "Declaration Under 37 C.F.R. §1.132 including Exhibits A, B, C and D" dated Jul. 24, 2017 (235 pages).

Gaddy, Dean E., "Critical path analysis improves rig-moving procedures", Oil & Gas Journal, Nov. 16, 1998 (5 pages).

* cited by examiner

SIDE SADDLE SUBSTRUCTURE

CROSS-REFERENCE TO RELATED APPLICATIONS

This application is a continuation of U.S. non-provisional application Ser. No. 15/191,094, filed Jun. 23, 2016, which is a continuation of U.S. non-provisional application Ser. No. 14/180,049, filed Feb. 13, 2014, and now granted as U.S. Pat. No. 9,810,027, which is itself a non-provisional application which claims priority from U.S. provisional application No. 61/764,259 filed Feb. 13, 2013.

FIELD OF THE DISCLOSURE

The present disclosure relates generally to drilling rigs, and specifically to box-on-box rig structures for land drilling in the petroleum exploration and production industry.

BACKGROUND OF THE DISCLOSURE

Land-based drilling rigs may be configured to be skidded from location to location to drill multiple wells within the same area known as a wellsite. In certain situations, it is necessary to skid across an already drilled well for which there is a well-head in place. Further, mast placement on land-drilling rigs may have an effect on drilling activity. For example, depending on mast placement on the drilling rig, an existing well-head may interfere with the location of land-situated equipment such as, for instance, existing well-heads, and may also interfere with raising and lowering of equipment needed for operations.

SUMMARY

The present disclosure provides for a drilling rig. The drilling rig may include a first substructure; a second substructure, the second substructure being positioned generally parallel to and spaced apart from the first substructure and being generally the same height as the first substructure; and a drill floor coupled to the first and second substructures, the drill floor positioned substantially at the top of the first and second substructures.

The present disclosure also provides for a substructure for use in a drilling rig. The substructure may include a substructure frame, the substructure frame configured to at least partially support a drilling floor; and a tank support structure affixed to the substructure.

The present disclosure also provides for a drilling rig. The drilling rig may include a first substructure; a second substructure, the second substructure being positioned generally parallel to and spaced apart from the first substructure and being generally the same height as the first substructure; and a drill floor coupled to the first and second substructures. The drill floor may be positioned substantially at the top of the first and second substructures. The drill floor may include a V-door, the V-door generally aligned with a side of the drill floor, and the side of the drill floor with which the V-door is aligned may face towards the first or second substructure. The drilling rig may also include a mast coupled to the drill floor. The drilling rig may also include a tank support structure affixed to the first or second substructure. The tank support structure may include a tank and mud process equipment. The drilling rig may also include a grasshopper positioned to carry cabling and lines to the drilling rig. The grasshopper may be positioned to couple to the drill floor generally at a side of the drill floor, and the side of the drill floor to which the grasshopper couples may face towards the first or second substructure.

BRIEF DESCRIPTION OF THE DRAWINGS

The summary and the detailed description are further understood when read in conjunction with the appended drawings. For the purpose of illustrating the present disclosure, there are shown in the drawings exemplary embodiments of said disclosure; however, the disclosure is not limited to the specific methods, compositions, and devices disclosed. In addition, the drawings are not necessarily drawn to scale. In the drawings.

DETAILED DESCRIPTION

The present disclosure may be understood more readily by reference to the following detailed description, taken in connection with the accompanying figures, which form a part of this disclosure. It is to be understood that this disclosure is not limited to the specific devices, methods, applications, conditions or parameters described and/or shown herein, and that the terminology used herein is for the purpose of describing particular embodiments by way of example only and is not intended to be limiting of the present disclosure. Also, as used in the specification, including the appended claims, the singular forms "a," "an," and "the" include the plural, and reference to a particular numerical value includes at least that particular value, unless the context clearly dictates otherwise. The term "plurality," as used herein, means more than one.

Figure 1:
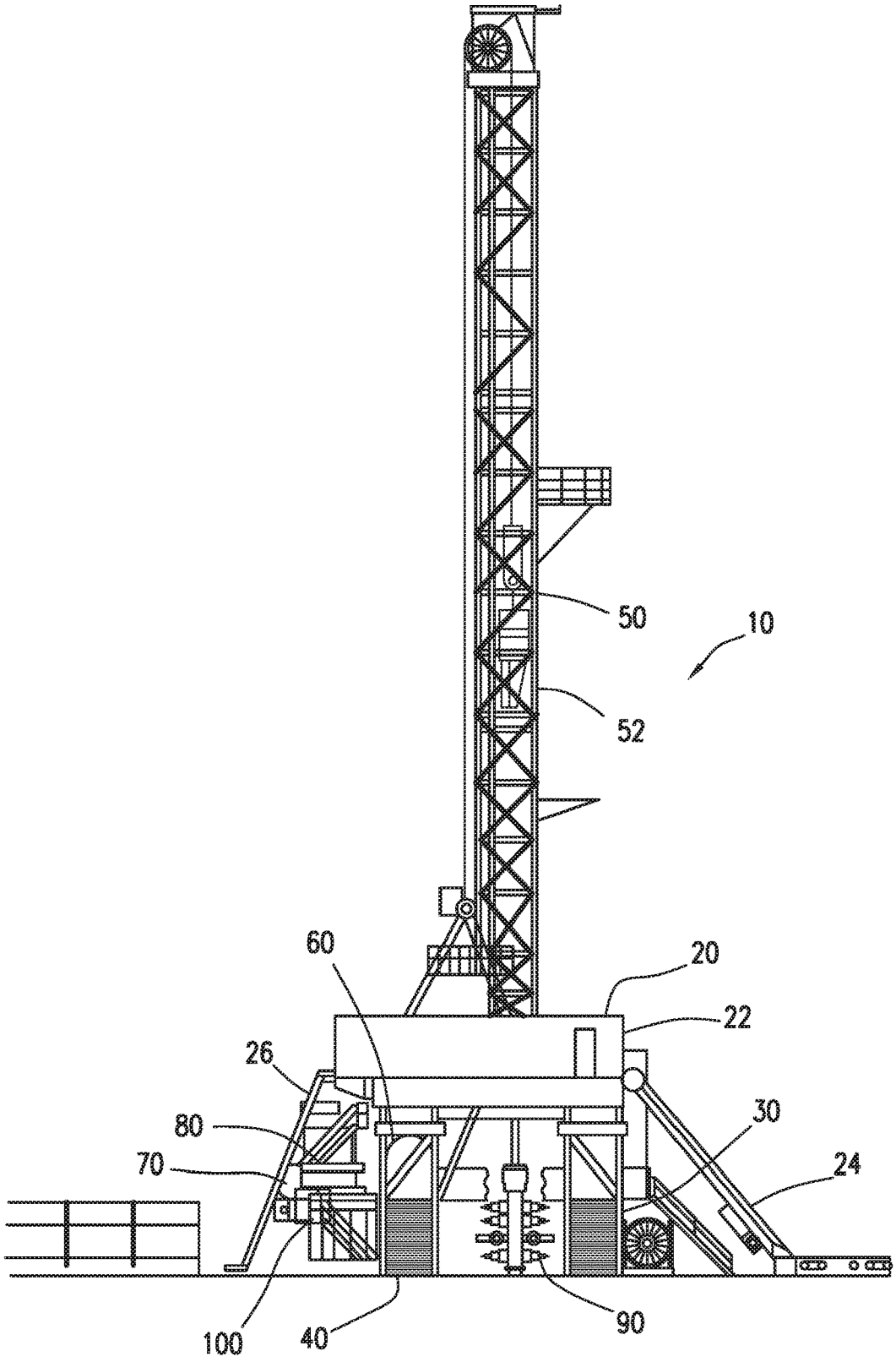
FIG. 1 is a side elevation from the driller's side of a drilling rig consistent with at least one embodiment of the present disclosure.
Figure 3:
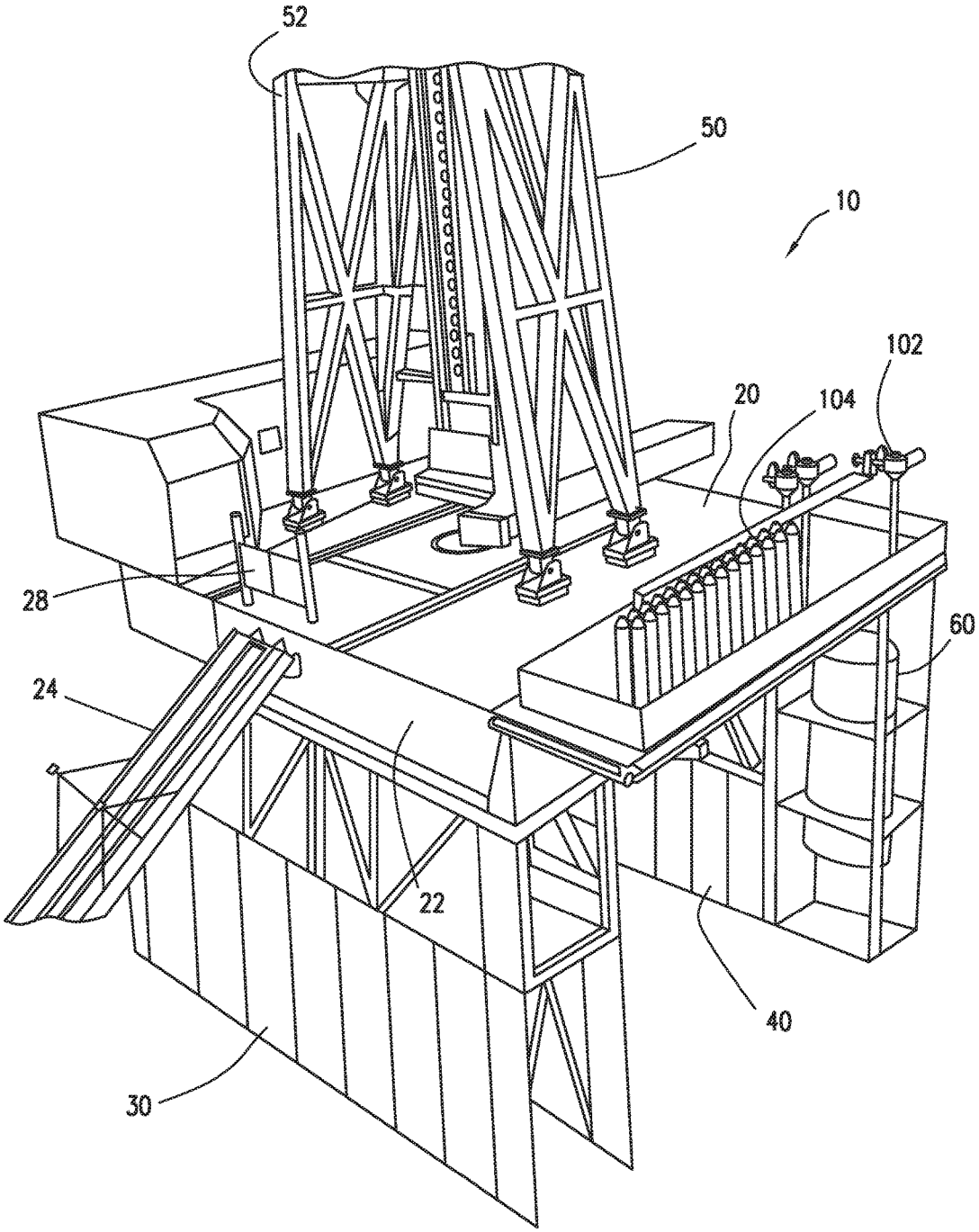
FIG. 3 is an isometric view of a drilling rig consistent with at least one embodiment of the present disclosure.
Figure 4:
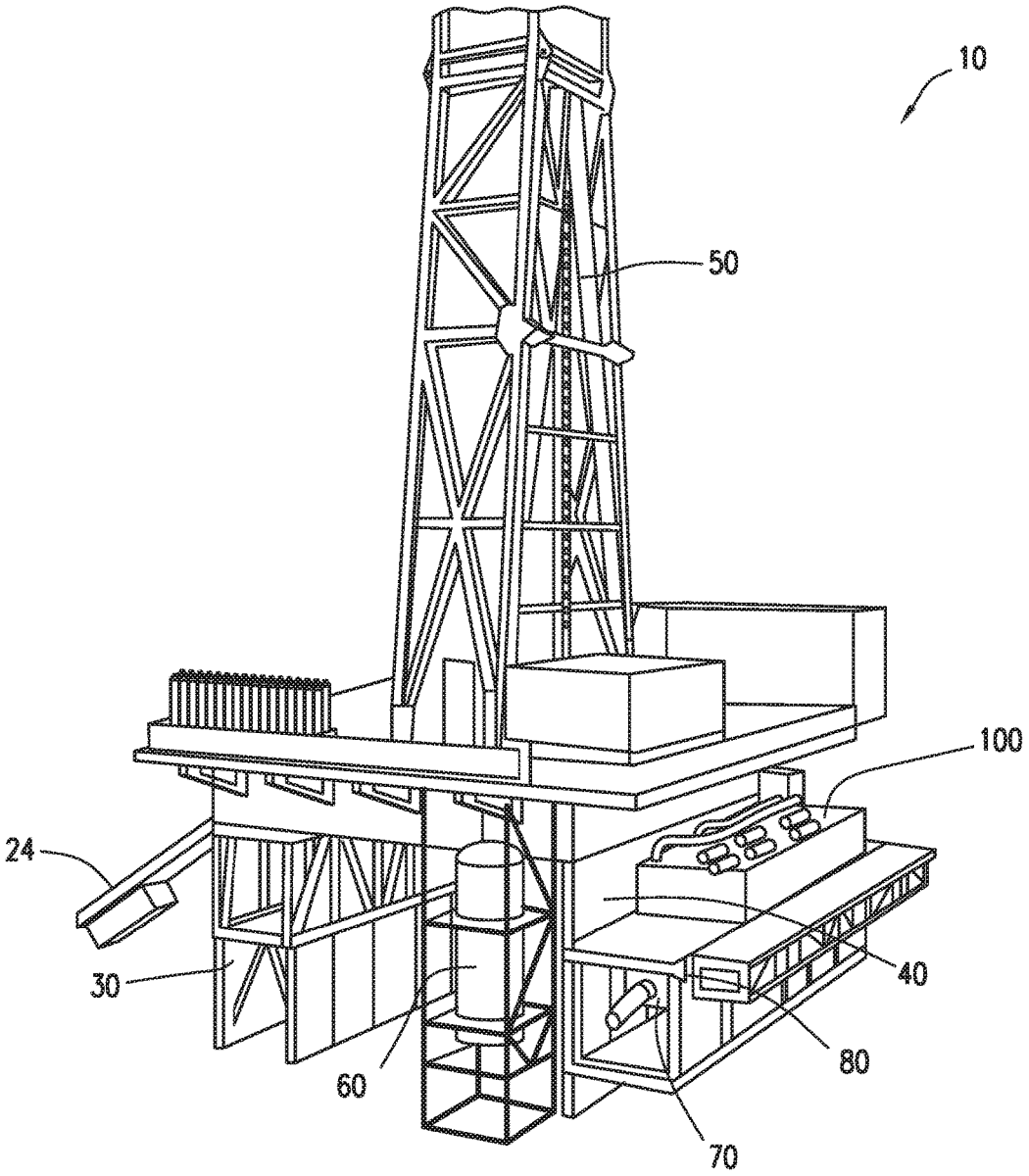
FIG. 4 is an isometric view of a drilling rig consistent with at least one embodiment of the present disclosure.

FIG. 1 depicts a side elevation of drilling rig 10 from the "driller's side" consistent with at least one embodiment of the present disclosure. Drilling rig 10 may include drill rig floor 20, right substructure 30, and left substructure 40. Right and left substructures 30, 40 may support drill rig floor 20. Mast 50 may be coupled to drill rig floor 20. As would be understood by one having ordinary skill in the art with the benefit of this disclosure, the terms "right" and "left" as used herein are used only to refer to each separate substructure to simplify discussion, and are not intended to limit this disclosure in any way. Mud gas separator tank 60 may be positioned within right or left substructures 30, 40, as shown in FIG. 1 or cantilevered from the left or right substructures 30, 40 as shown in FIGS. 3 and 4. V-door side 22 of drilling rig 10 may be located over right substructure 30. The V-door side 52 of mast 50 may correspondingly face right substructure 30. Pipe handler 24 may be positioned to carry piping through a V-door as understood in the art positioned on V-door side 22 of drilling rig 10. In some embodiments, grasshopper 26 may be positioned to carry cabling and lines to drilling rig 10. In other embodiments (not shown), V-door side 22 and mast V-door side 52 may face left substructure 40. In some embodiments, as depicted in FIG. 1, blow out preventer 90 may be located between left substructure 40 and right substructure 30, i.e. drilling rig 10 may be centered over a wellbore.

In some embodiments, tank support structure 80 and tanks 70 may be included in drilling rig 10. Tank support structure 80 may be affixed to right substructure 30 or left substructure 40 by means known to those of ordinary skill in the art with the benefit of this disclosure, including, but not limited to, welding and bolting. As shown in FIG. 1, tank support structure 80 may be affixed to left substructure 40. Tank support structure 80 may be located on the opposite substructure from V-door side 22 of drilling rig 10. Tanks 70 may, for example, be mud tanks, auxiliary mud tanks, or other tanks useful in drilling operations and may be located within tank support structure 80. In some embodiments, mud process equipment 100 may also be mounted within tank support structure 80. Mud process equipment may include, for example, shakers, filters, and other equipment associated with the use of drilling mud.

Figure 2:
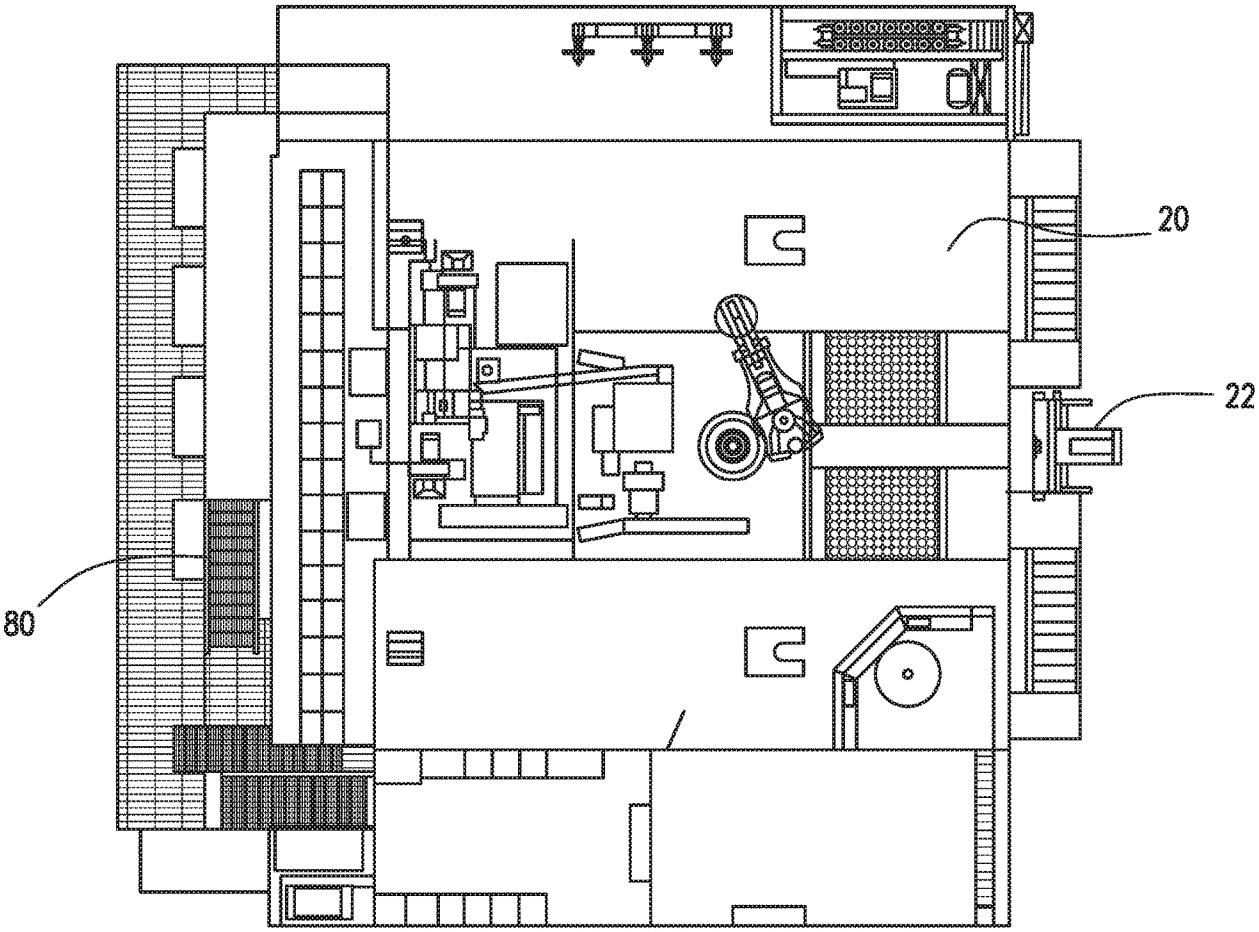
FIG. 2 is an overhead view of a drilling rig consistent with at least one embodiment of the present disclosure.

FIG. 2 depicts an overhead view of drilling rig 10 consistent with at least one embodiment of the present disclosure in which V-door side 22 of drilling rig 10, drill rig floor 20, and tank support structure 80 are shown. In some embodiments, choke manifold 102 may likewise be located on the rig floor. In some embodiments, accumulator 104 may likewise be located on the rig floor.

FIG. 3 depicts drilling rig 10 having drill rig floor 20. Drill rig floor 20 includes V-door side 22. Pipe handler 24 may connect to drilling floor 20 through V-door 28. FIG. 3 further depicts V-door side 22 of drilling rig 10 above right substructure 30 and perpendicular to the long axis of right substructure 30. FIG. 3 also depicts V-door side 52 of mast 50 perpendicular to the long axis of right substructure 30. Left substructure 40 is shown opposite right substructure 30. As shown in FIG. 3, right substructure 30 and left substructure 40 are elongated substructures. FIG. 4 depicts tank support structure 80 affixed to left substructure 40. Tanks 70 are shown positioned within tank support structure 80. Mud process equipment 100 is located within tank support structure 80.

As they are mounted directly to a substructure (30 or 40) of drilling rig 10, tanks 70, mud process equipment 100, choke manifold 102, and accumulator 104 may travel with drilling rig 10 during a skidding operation. As such any pipe or tubing connections between or taken from tanks 70, mud process equipment 100, choke manifold 102, and/or accumulator 104 may remain connected during the skidding operations. This arrangement may allow, for example, more rapid rig disassembly ("rigging-down") and assembly (or "rigging-up") of drilling rig 10 before and after a skidding operation.

Additionally, by facing V-door side 22 of drilling rig 10 toward one of the substructures 30, 40, equipment and structures that pass through the V-door or to drilling floor 20 from V-door side 22 of drilling rig 10 may, for example, be less likely to interfere with additional wells in the well field.

One having ordinary skill in the art with the benefit of this disclosure will understand that the specific configuration depicted in FIGS. 1, 2 may be varied without deviating from the scope of this disclosure.

Those skilled in the art will appreciate that numerous changes and modifications can be made to the preferred embodiments of the present disclosure and that such changes and modifications can be made without departing from the spirit of said disclosure. It is, therefore, intended that the appended claims cover all such equivalent variations as fall within the true spirit and scope of said disclosure.

What is claimed is:

1. A box-on-box land based drilling rig comprising:

a first elongated substructure;

a second elongated substructure, the second elongated substructure being positioned generally parallel to and spaced apart from the first elongated sub structure;

a drill rig floor fixedly coupled to the first and second elongated substructures; and a mast coupled to the drill rig floor, wherein the mast further comprises a V-door side and wherein the V-door side of the mast is perpendicular to a long axis of the first elongated substructure, wherein the box-on-box land based drilling rig is adapted to be traveled in an assembled state through a wellsite.

2. The land based drilling rig of claim 1, further comprising a choke manifold, the choke manifold positioned on the drill rig floor.

3. The land based drilling rig of claim 2, wherein a catwalk is coupled to the first elongated substructure or second elongated substructure and is adapted to travel with the land based drilling rig.

4. The land based drilling rig of claim 1, wherein the land based drilling rig is a box-on-box rig.

5. The land based drilling rig of claim 1, wherein the drill rig floor comprises a V-door, the V-door generally aligned with a V-door side of the drill rig floor, the V-door side of the drill rig floor aligned perpendicular to a long axis of the first elongated substructure.

6. The land based drilling rig of claim 1 further comprising one or more tanks, the one or more tanks positioned within the land based drilling rig.

7. The land based drilling rig of claim 1 further comprising a mud gas separator, the mud gas separator positioned within the first elongated substructure or the second elongated substructure.

8. The land based drilling rig of claim 1 further comprising a pipe handler, the pipe handler positioned to carry piping through a V-door on the V-door side of the drill rig floor.

* * * * *